US005148189A

United States Patent [19]

Kuwabara et al.

[11] Patent Number: 5,148,189

[45] Date of Patent: Sep. 15, 1992

[54] THERMAL PRINT HEAD

[75] Inventors: Osamu Kuwabara; Jiro Mutoh; Akihiko Abe, all of Tokyo, Japan

[73] Assignee: Casio Computer Co., Ltd., Tokyo, Japan

[21] Appl. No.: 701,225

[22] Filed: May 16, 1991

[30] Foreign Application Priority Data

May 30, 1990 [JP] Japan ..... 2-138577

[51] Int. Cl.[5] ..... E01D 15/10

[52] U.S. Cl. ..... 346/76 PH

[58] Field of Search ..... 346/76 PH, 76 DH

[56] References Cited

U.S. PATENT DOCUMENTS 4,768,038 8/1988 Shibata ..... 346/76 PH 4,968,996 11/1990 Ebihara et al. ..... 346/76 PH

FOREIGN PATENT DOCUMENTS

0235827A2 9/1987 European Pat. Off. .

*Primary Examiner*—Benjamin R. Fuller

*Assistant Examiner*—Gerald E. Preston

*Attorney, Agent, or Firm*—Frishauf, Holtz, Goodman & Woodward

[57] ABSTRACT

A thermal print head includes a plurality of selective electrodes formed on a substrate, a common electrode formed on the substrate at a distance from the selective electrodes, and a fiber mounted on the substrate at a position between the common electrode and the selective electrodes. The fiber projects higher than the top surfaces of the common and selective electrodes, and is fixed to the substrate by an adhesive having a top surface which is upwardly inclined toward the fiber. Heat resistive films overlay the fiber and adhesive and electrically connect the selective electrodes to the common electrode.

18 Claims, 4 Drawing Sheets

THERMAL PRINT HEAD

BACKGROUND OF THE INVENTION

1. Field of the Invention

The present invention relates to a thermal print head for thermal printing.

2. Description of the Related Art

The thermal print head which has such a structure as shown in FIGS. 8 and 9 is well-known. In FIGS. 8 and 9, reference numeral 1 denotes a substrate made of ceramics or the like. Swelled portions 2 having a certain interval relative to its adjacent ones and each being made of $SiO_2$, $SiN_1$ or the like are formed on the substrate 1 in the width direction thereof by the CVD (Chemical Vapor Deposition) method. Thermal resistive thin films 3 are formed on the substrate 1 and on each of the swelled portions 2. Electrodes 4 and 5 are formed on each of the thermal resistive thin films 3 except the center portion of the film 3. The electrodes are selective ones and the other electrode 5 is a common one. The common electrode 5 is connected to ground potential. The electrodes 4, 5, the center portions of the thermal resistive thin films 3, and the exposed portion of the substrate 1 are coated by an insulating protection film 6 (not shown in FIG. 9).

In the case of this thermal print head, printing current supplied selectively responsive to printing data is applied to the common electrode 5 through the center portions of the thermal resistive thin films 3. Center portions of the thermal resistive thin films 3 which are not covered by the electrodes are selectively heated by printing current. These center portions or heated portions of the thermal resistive thin films 3 are kept higher by the swelled portions 2 than the protection film 6 on the substrate 1, so that they can be reliably contacted with a sheet of printed paper to clearly print thereon.

In the case of the thermal print head having the above-described structure, however, it is desirable that each of the swelled portions 2 is formed to have a smooth slope from the bottom to the top thereof and made sufficiently higher than the other portion of the substrate 1. An extremely long processing time is needed to form each of the swelled portions 2 with a thickness of the order of microns according to the CVD method. Further, it is quite difficult to smoothly tilt the rim portion of each of the swelled portions 2 according to the thin film forming manner. Furthermore, the cost becomes disadvantageously high because the substrate 1 must be made of expensive material.

In order to solve these problems, there has been discussed a manner of print-forming the thermal resistive films on a flexible substrate by carbon ink. The swelling of the heated portions is carried out in this case by forming the swelled portions at intended portions of a support member mounted on a hard substrate and laminating the flexible substrate onto the support member while corresponding the thermal resistive thin films to the swelled portions of the support member. According to this print-forming method, however, the difference of film thicknesses of the thermal resistive thin films is larger, thereby making their temperatures more uneven when they are heated than that according to the CVD method. In this method, further, there is a difficulty having a uniformity of the heights for all the swelled portions. Therefore, this method can make the cost of printing lower but the quality of printing worse.

SUMMARY OF THE INVENTION

An object of the present invention is therefore to provide a thermal print head lower in cost and more excellent in print quality.

Another object of the present invention is to provide a thermal print head having such a structure as enables heated portions of thermal resistive thin films to be more efficiently swelled to a same extent from a substrate.

According to an aspect of the present invention, there is provided a thermal print head comprising a substrate; a plurality of selective electrodes formed on the substrate and each having an edge; a common electrode formed on the substrate at a distance from respective edges of the selective electrodes; a fiber mounted on the substrate at a position between the common electrode and all the edges of the selective electrodes, the fiber projecting higher than the top surfaces of the common and selective electrodes; adhesive means for coupling the fiber to the substrate, the adhesive means having a top surface which is upwardly inclined toward the fiber; and heat resistive means having portions each overlying the fiber and the adhesive means and electrically connecting each of the selective electrodes to the common electrode.

DETAILED DESCRIPTION OF THE PREFERRED EMBODIMENTS

An embodiment of the present invention will be described with reference to FIGS. 1 through 6.

Figure 1:
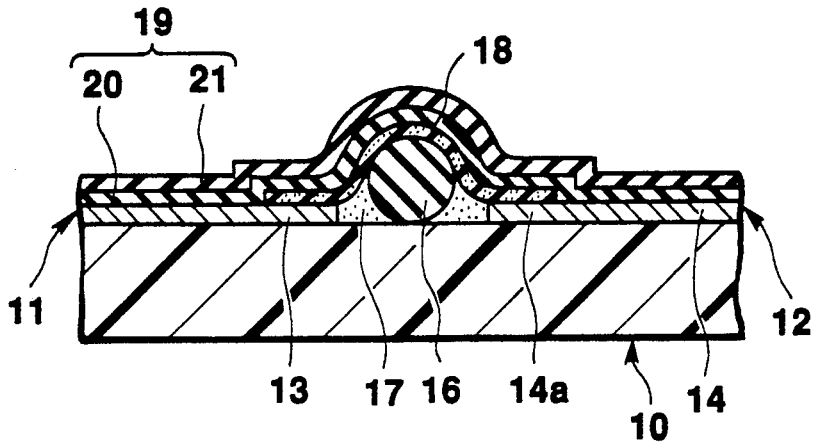
FIG. 1 is an enlarged sectional view showing the main portion of the thermal print head according to a first embodiment of the present invention.
Figure 2:
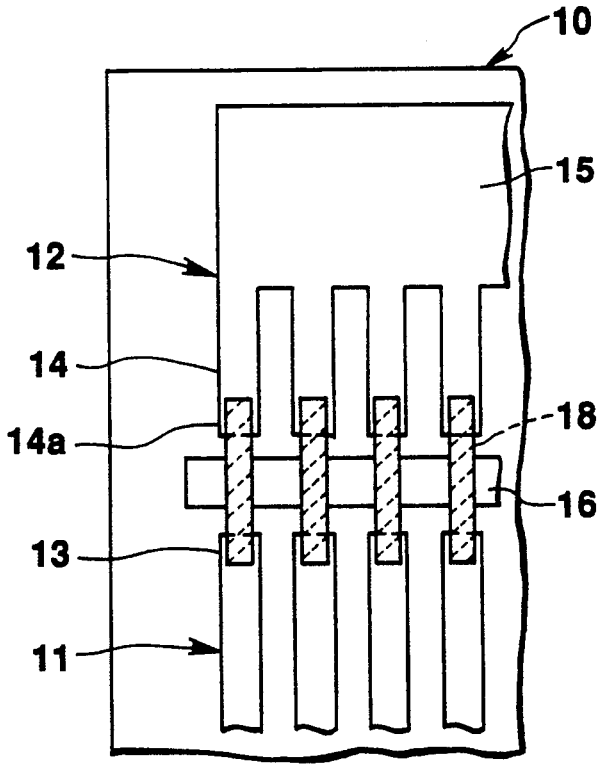
FIG. 2 is a plan view showing the thermal print head from which a protection layer is removed, shown in FIG. 1.

FIGS. 1 and 2 show the main portion of a thermal print head. In these Figures, reference numeral 10 represents a film substrate, which is made of synthetic resin such as polyimide. Strip-like selective electrodes 11 and a common electrode 12 are arranged all over the film substrate 10 in the width direction thereof in such a manner that the selective electrodes 11 are opposed to the common one 12 with a certain interval interposed between them. The selective and common electrodes 11 and 12 are made by a single layer of Cu or Al, or by multi-layers of metal formed by plating Ni, Au or the like on the single layer of Cu or Al. Their film thickness is made relatively large or about 10 μm so as to allow a large amount of current to pass through them even when their width is small, ranging from 30 μm to 70 μm. Each of the selective electrodes 11 has an end portion 13 extending toward the common electrode 12, as shown in FIG. 2. The common electrode 12 has leads 14 each extending toward the end portion 13 of its corresponding selective electrode 11.

A fiber 16 is arranged on the film substrate 10 between the end portions 13 of the selective electrodes 11 and the leads 14 of the common electrode 12 and bonded to the substrate 10 by an adhesive 17. The fiber 16 is a string made of transparent or opaque heat-resisting material such as glass, quartz and resin. The fiber 16 has a circular cross section whose diameter is 20 - 100 μm, preferably about 50 μm and it is projected upward higher than the top surface of the electrodes 11 and 12. It is desirable that the adhesive 17 is one of the polyimide group which has high reliability relative to heat stress, but it is not limited to those of the polyimide group.

Thermal resistive thin films 18 are arranged on the fiber 16 at a certain interval of about 16 dots/mm, for example. Namely, each of the thermal resistive thin films 18 is held on the fiber 16 and the adhesive 17 with its both ends seated on the front part of one end portion 13 of the selective electrodes 11 and the front end 14*a* of that lead 14 of the common electrode 12 which corresponds to the one end portion 13. It is made of tantalum silicide such as TaN and $Ta_2N$ and its film thickness is small or about 1000 Å. A protection layer 19 is formed on the thermal resistive thin films 18 and the adhesive 1 exposed between the thermal resistive thin films 18. This protection layer 19 comprises double layers of a moisture protection film 20 made of $SiO_2$ or the like and a wear protection film 21 made of $Ta_2O_5$ or the like.

Although not shown, drive transistors for selectively supplying printing current to the selective electrodes, control elements for controlling the drive transistors and the like are arranged as a unit o the film substrate 10.

The manner of making the above-described thermal print head will be described with reference to FIGS. 3 through 6.

Figure 3:
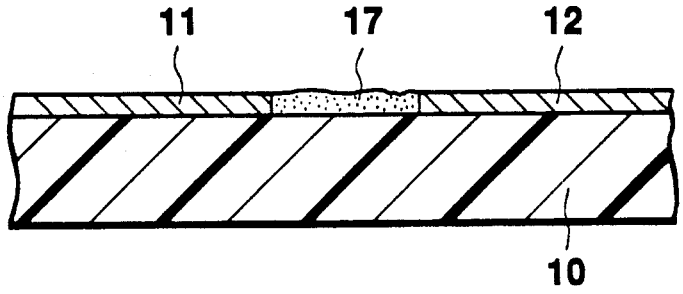
FIG. 3 is a sectional view showing electrodes and adhesive formed on a film substrate for explaining a manner of making the thermal print head shown in FIG. 1.

As shown in FIG. 3, the selective electrodes 11 and the common electrode 12 are formed on the film substrate 10. This process is carried out in such a way that chrome (Cr) is deposited on the film 10 by the vacuum vapor deposition or sputtering method, that copper (Cu) and, if necessary, nickel (Ni) and gold (Au) are successively plated on the chrome according to the electrolytic plating method to form a metal layer about 10 μm thick, and that this metal layer is patterned by a photo-lithography technique. This photo-lithography technique means that a photo-resist is coated on a metal layer to transfer the pattern of a mask to the photo-resist and that the photo-resist and the metal layer are patterned by etching. After the electrodes 11 and 12 are formed, the adhesive 17 of the polyimide group is coated on the substrate 10 between the front ends of the end portions 13 of the selective electrodes 11 and the front ends 14*a* of the leads 14 of the common electrode 12 in the direction in which these electrodes 11 and 12 are arranged on the substrate 10.

Figure 4:
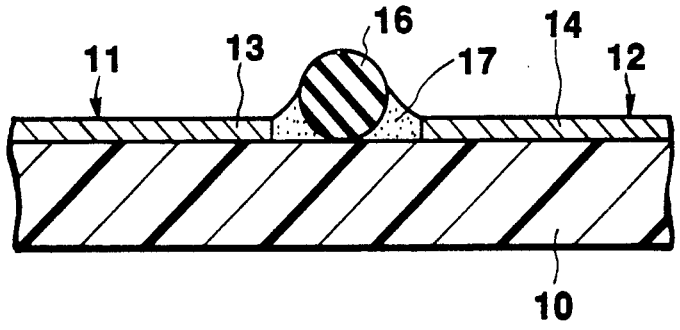
FIG. 4 is a sectional view showing a fiber mounted on the substrate on which the electrodes and the adhesive have been formed as shown in FIG. 3.
Figure 5:
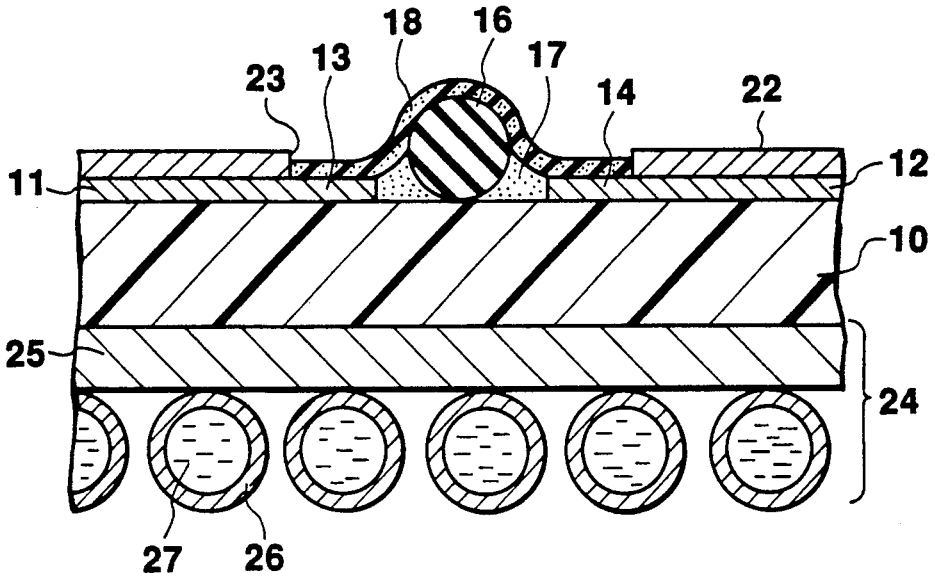
FIG. 5 is a sectional view for explaining the manner of forming a thermal resistive thin film on the fiber, after the state shown in FIG. 4.

The fiber 16 whose diameter is about 50 μm is then seated on the adhesive 17, as shown in FIG. 4. When the adhesive 17 is sufficiently low in viscosity, for example, five thousands to ten thousands centipoises, the fiber 16 is shifted while sinking in the adhesive 17 due to the surface tension of the adhesive 17 and stopped on a center line between the front ends of the end portion 13 and those 14*a* of the leads 14. The fiber 16 is contacted this time with the top of the substrate 10. In other words, the adhesive 17 gradually rises from the end walls of the end portions 13 and the leads 14 of the electrodes 11 and 12 to a widest surface portion of the fiber 16, as shown in FIG. 4.

The adhesive 17 is then dried and the thermal resistive thin films 18 are formed on the adhesive 17 and the fiber 16. The forming of these thermal resistive thin films 18 is carried out either by using the metal mask or by the photo-lithography technique.

In the case of the former, a metal mask 22 is arranged on the film substrate 10 (or electrodes) and tantalum silicide is then coated on it. The metal mask 22 is provided in this case with openings 23 which are located to correspond to the thermal resistive thin films 18 or each of which extends from the one end portion 13 of the selective electrodes 11 to its corresponding front part 14*a* of the lead 14 of the common electrode 12, passing over the fiber 16. When the metal mask 22 is arranged on the film substrate 10, therefore, those areas where the thermal resistive thin films 18 are to be formed are exposed. When tantalum silicide is deposited under this state by the sputtering manner and the metal mask 22 is then removed from the film substrate 10, tantalum silicide is deposited only at those areas which correspond to the openings 23 of the metal mask 22. Each of the thermal resistive thin films 1 is thus formed connecting the on end portion 13 of the selective electrodes 11 to its corresponding front part 14*a* of the lead 14 of the common electrode 12 while passing over the fiber 16. The fibers used for the optical communication system generally have an extremely low irregularity in their diameters and when these fibers are used, therefore, each of the thermal resistive thin films 18 can have a substantially same height from the top of the film substrate 10. Since tantalum silicide is to be deposited on the adhesive 1 which gradually rises from the electrodes 11 and 12 to the fiber 16, the thermal resistive thin films 18 are not broken even so easy if they are formed extremely thin.

In the case of the latter, tantalum silicide is deposited all over the film substrate 10 by the sputtering. A photoresist is coated on this tantalum silicide film and patterned by the photo-lithography technique, and the tantalum silicide film is then etched, using the photoresist as a mask, to remove the unnecessary portion of the tantalum silicide film. The thermal resistive thin films 18 can be similarly formed even by this manner.

Whichever of these two techniques may be used, tantalum silicide is deposited on the film substrate 10 by the sputtering while cooling the substrate 10 by a cooling device 24. This cooling device 24 is for cooling the substrate 10 to a predetermined temperature of 50°-60° C., for example, by running cooling liquid 27 through plural cooling pipes 26 located under a stainless steel plate 25 on which the film substrate 10 is mounted. According to tests conducted, the film substrate 10 was heated to 150°-200° C. when no cooling was carried out, but when it was cooled to 50°-60° C., the film substrate 10 caused no thermal deformation and tantalum silicide could be formed even and flat on it.

Figure 6:
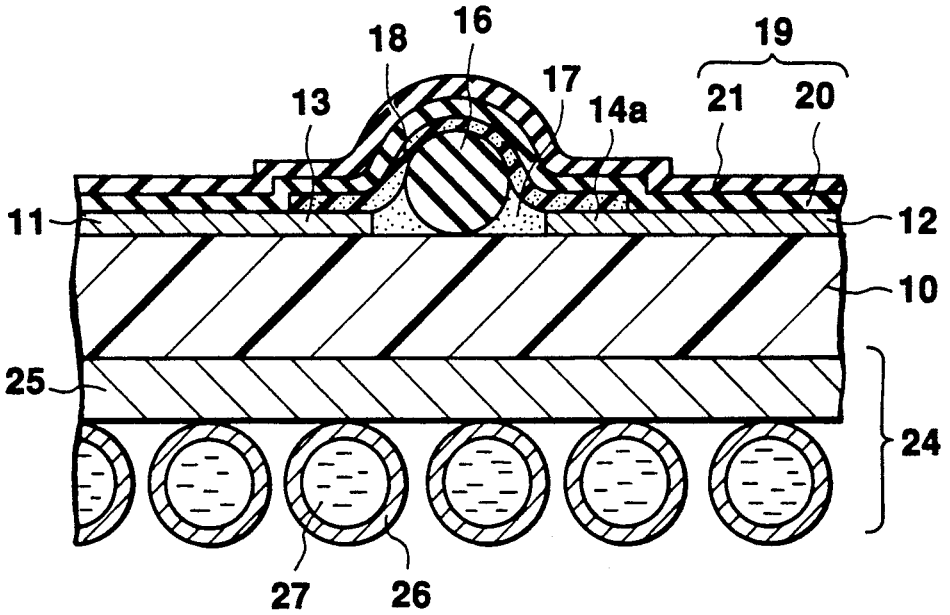
FIG. 6 is a sectional view for explaining the manner of making the head which is under the state shown in FIG. 5 as a final product.

As shown in FIG. 6, the layer 19 for protecting the thermal resistive thin films 18 and the electrodes 11 and 12 is formed all over the substrate 10 as follows. $SiO_2$ is developed all over the substrate 10 by the thermal oxidation process or the CVD to form the moisture protection film 20 and $Ta_2O_5$ is then developed on the surface of the film 20 by the CVD to form the wear protection film 21. These protection films 20 and 21 are formed also in this case while cooling the substrate 10 by the cooling device 24. Therefore, they can be stably formed, as described above, without being subjected to thermal stress. Those portions of the protection layer 19 which correspond to the heated portions of the thermal resistive thin films 18 are projected sufficiently higher than the remaining portion thereof. The heated portions of the thermal resistive thin films 18 can be thus fully contacted with a sheet of recording paper or the like, thereby enabling the printing quality to be made more excellent with clearer printed letters.

Figure 7:
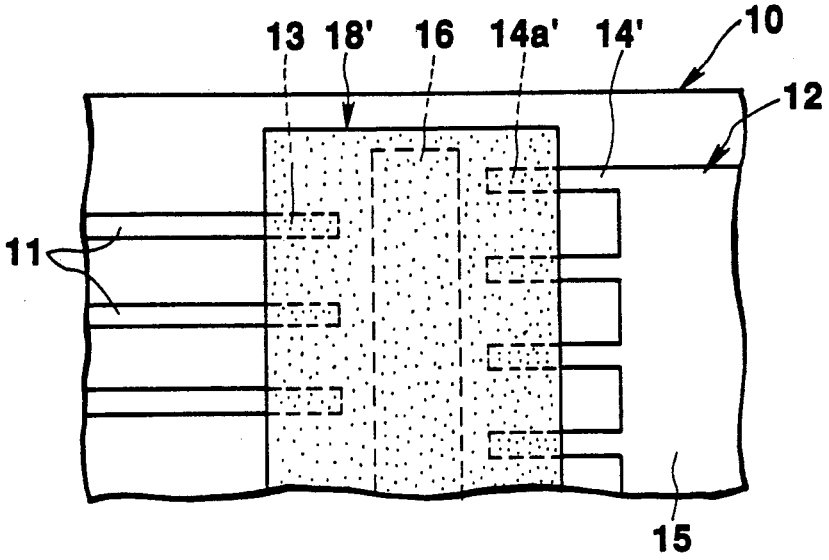
FIG. 7 is an enlarged plan view showing another embodiment of the present invention.
Figure 8:
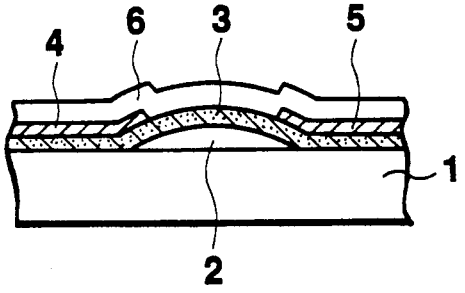
FIG. 8 (PRIOR ART)
FIG. 8 is an enlarged sectional view showing the main portion of the conventional thermal print head.
Figure 9:
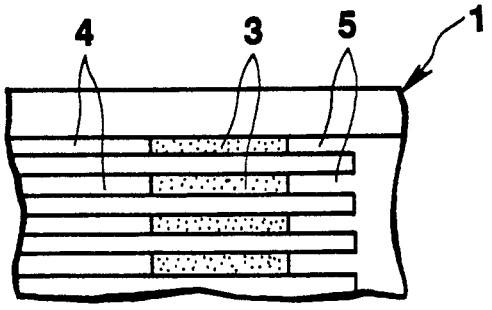
FIG. 9 (PRIOR ART)
FIG. 9 is a plan view showing the thermal print head in FIG. 8.

The thermal resistive thin films 18 have been formed corresponding to each of the selective electrodes 11 in the case of the above-described embodiment. However, it is not necessarily needed that the thermal resistive thin films 18 are formed in this manner. FIG. 7 shows another example of the thermal resistive thin film. This thermal resistive thin film 18' is formed like a strip covering all of end portions 13 and **14*a'* of the electrodes 11 and 12 and that area of the substrate 10 which is between these end portions 13 and 14*a'* thereof. In addition, each of the selective electrodes 11 is located on a line extending to the center between the two adjacent leads 14' of the common electrode 12. As can be easily understood, the thermal resistive thin film 18' in this case can be more efficiently formed, as compared with those of the first embodiment. However, there is the possibility that the surface of the paper sheet on which letters are printed is made dirty by current leaked from one of the selective electrodes 11 to the other selective electrodes 11 or to those leads 14' of the common electrode 12 which do not correspond to this one selective electrode 11 in theory. It is confirmed by the inventors, however that no influence of dirt, by the above-mentioned reason, is appeared in the surface of the paper sheet and extremely excellent printing quality was thus achieved, even when letters were printed at a high resolution of about 16 dots/mm. Other components of this embodiment shown in FIG. 7** are same as those in the first embodiment and description on these components will be omitted accordingly.

It should be understood that the present invention is not limited to the above-described embodiments. Glass, quartz, ceramics and the like can be used instead of the film member to make the substrate. Multi-crystal silicon doped with ruthenium oxide and ions, and the like may be used instead of tantalum silicide to form the thermal resistive thin film or films. The thermal resistive thin films 18 and 18' may be formed not directly on the fiber 16 and the adhesive 17 but indirectly on them with an insulating film such as film of silicon oxide or polyimide interposed. Grooves in which the fibers are seated may be formed on the substrate to more reliably fix the fibers to the substrate.

What is claimed is:

1. A thermal print head comprising:

a substrate;

a plurality of selective electrodes formed on said substrate, each of said selective electrodes having an edge;

a common electrode formed on said substrate at a distance from respective edges of said selective electrodes;

a fiber, formed as a string-like member, mounted on said substrate at a position between said common electrode and the edges of all of said selective electrodes, said fiber projecting to a position higher than top surfaces of said common and selective electrodes;

an adhesive fixedly connecting said fiber to said substrate, and said adhesive having a top surface which is upwardly inclined toward the fiber; and heat resistive means having portions each overlying said fiber and said adhesive, for electrically connecting each of said selective electrodes to said common electrode.

2. The thermal print head according to claim 1, wherein said substrate is made of synthetic resin.

3. The thermal print head according to claim 2, wherein said substrate is made of polyimide.

4. The thermal print head according to claim 1, wherein said fiber is made of glass.

5. The thermal print head according to claim 1, wherein said adhesive includes a polyimide adherence.

6. The thermal print head according to claim 1, wherein said heat resistive means is formed of resistive material depositions.

7. The thermal print head according to claim 6, wherein said heat resistive means is made of tantalum silicide material.

8. The thermal print head according to claim 1, wherein said fiber has a circular cross section.

9. The thermal print head according to claim 1, wherein said fiber extends along a center line between said selective electrodes and said common electrode.

10. The thermal print head according to claim 1, wherein said adhesive is positioned between said fiber, and said selective and common electrodes.

11. A thermal print head comprising:

a substrate;

a plurality of selective electrodes formed on said substrate, each of said selective electrodes having an edge;

a common electrode formed on said substrate and having a plurality of leads each of which extends towards said selective electrodes respectively;

a fiber, formed as a string-like member, mounted on said substrate at a position between said leads of said common electrode and said selective electrodes, said fiber projecting to a position higher than top surfaces of said common and selective electrodes;

an adhesive fixedly connecting said fiber to said substrate, said adhesive having a top surface which is upwardly inclined toward the fiber; and heat resistive elements respectively overlying said fiber and said adhesive, said heat resistive elements electrically connecting each of said selective electrodes to a corresponding one of said leads of said common electrode.

12. The thermal print head according to claim 11, wherein said fiber has a circular cross section, and wherein the diameter of said fiber is 20 to 100 microns.

13. The thermal print head according to claim 12, wherein said fiber is made of glass.

14. The thermal print head according to claim 13, wherein said substrate is made of synthetic resin.

15. The thermal print head according to claim 14, which further includes a protective film covering said heat resistive element.

16. The thermal print head according to claim 13, wherein said substrate is made of polyimide.

17. The thermal print head according to claim 16, which further includes a protective film covering said heat resistive element.

18. The thermal print head according to claim 1, wherein said fiber is made of quartz.

* * * * *